United States Patent [19]

Rose

[11] 3,957,321

[45] May 18, 1976

[54] SUSPENSION FILE FOLDER

[75] Inventor: Allen J. Rose, Chicago, Ill.

[73] Assignee: Acco International Inc., Chicago, Ill.

[22] Filed: Sept. 23, 1974

[21] Appl. No.: 508,520

[52] U.S. Cl. ..... 312/184; 402/17
[51] Int. Cl.[2] ..... B42F 13/00; A47B 63/00
[58] Field of Search ..... 312/184, 211; 402/17

[56] References Cited

UNITED STATES PATENTS

| | | | |
|---|---|---|---|
| 1,997,635 | 4/1935 | Forth | 402/17 |
| 2,165,157 | 7/1939 | Smith | 312/184 |
| 3,112,967 | 12/1963 | Hood | 312/184 |
| 3,572,867 | 3/1971 | Cooper | 312/184 |
| 3,628,877 | 12/1971 | Barnes, Jr. | 402/17 |
| 3,639,020 | 2/1972 | Nesbitt | 312/184 |
| 3,667,854 | 6/1972 | Jonas | 312/184 |
| 3,779,393 | 12/1973 | Grundell | 312/184 |
| 3,790,242 | 2/1974 | Sullivan | 312/184 |
| 3,826,582 | 7/1974 | Podosek | 312/184 |

FOREIGN PATENTS OR APPLICATIONS

| | | | |
|---|---|---|---|
| 874,994 | 8/1961 | United Kingdom | 312/184 |

*Primary Examiner*—Robert L. Wolfe
*Assistant Examiner*—Victor N. Sakran
*Attorney, Agent, or Firm*—Elmer L. Zwickel

[57] ABSTRACT

A suspension file folder having a suspension bar with hanger elements at its ends each formed with a hanger hook embodying means for suspending the file folder at one or both ends. The hanger elements can be integral with the suspension bar or slidable thereon into a plurality of positions.

1 Claim, 9 Drawing Figures

Fig. 1.
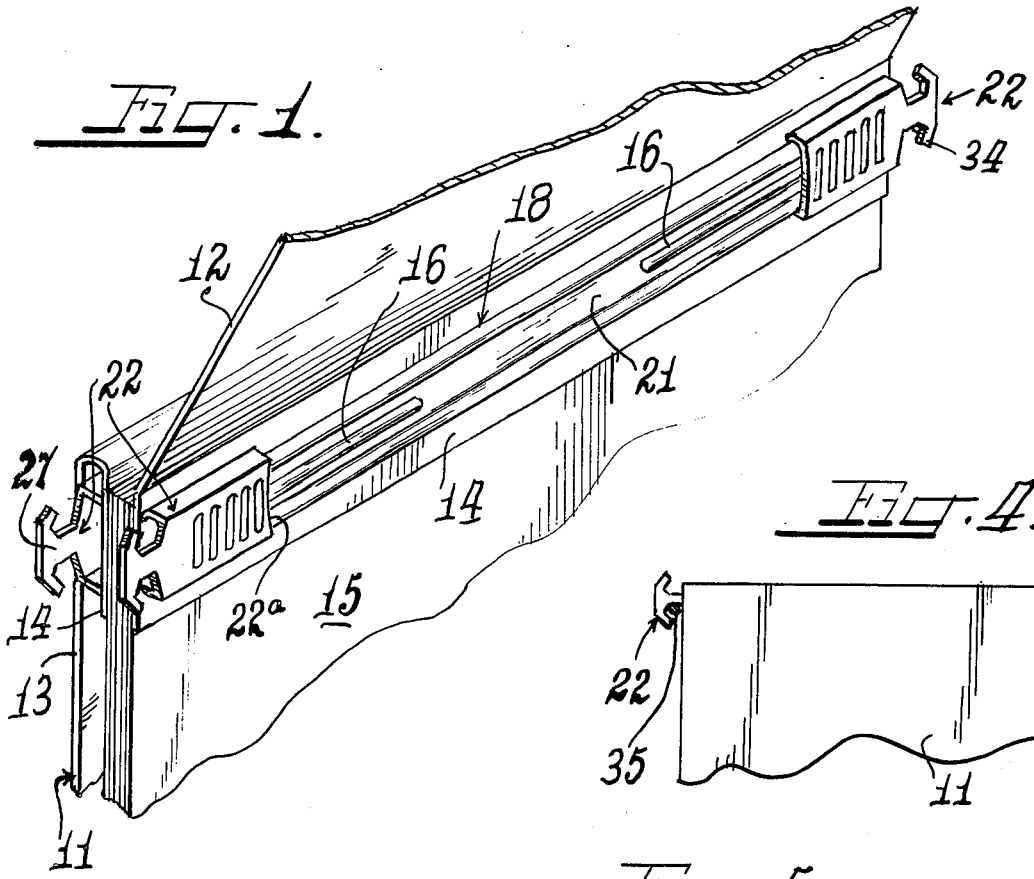
Fig. 4.
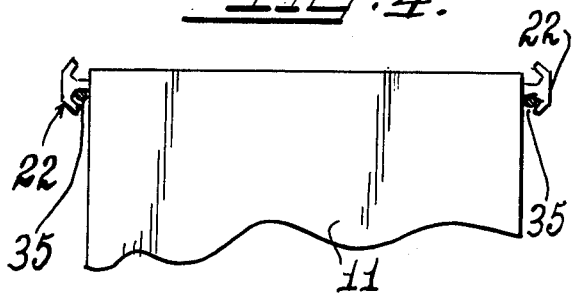
Fig. 5.
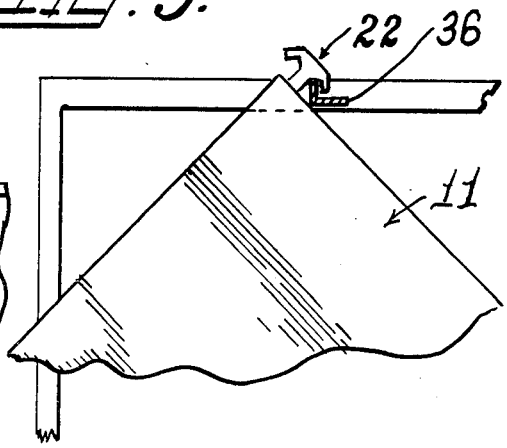
Fig. 2.
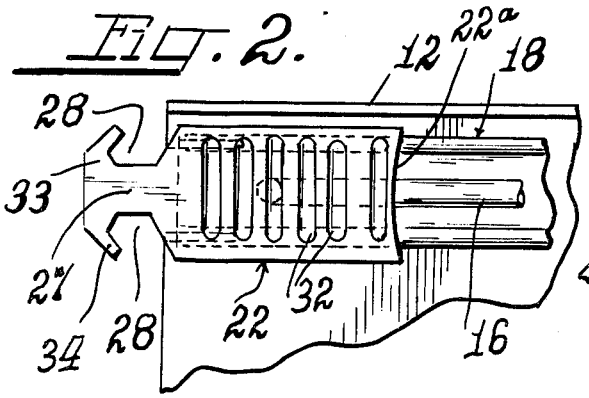
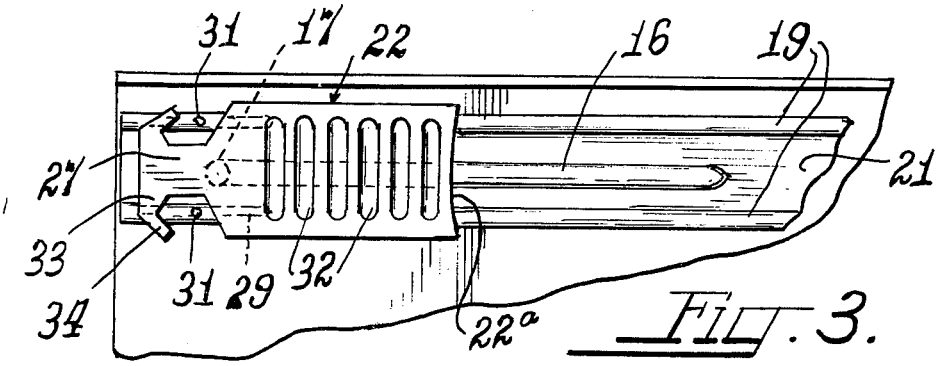
Fig. 3.

SUSPENSION FILE FOLDER

The invention relates to improvements in suspension file folders and is more particularly concerned with a hanger hook assembly incorporating fixed or movable elements for suspending the file folder from one or two support rods. The suspension elements are made integral with or are separately attached to a hanger or compressor bar. In either event the suspension elements embody a hook-like formation that adopts them to be mounted on one or two hanger rods or bars for suspending the file folder therefrom.

The invention is considered to be an improvement over Cooper U.S. Pat. No. 3,572,867, dated Mar. 30, 1971, and Barnes U.S. Pat. No. 3,628,877, dated Dec. 21, 1971, in that neither of these patents teaches applicant's novel hook-like suspension elements adopting the file folder to be suspended at both ends in a horizontal plane or at one end only in an angular position. The latter position is advantageous when viewing of indicia on the spine of the file folder is desired.

It is therefore an object of the invention to provide a suspension file folder with hanger means of the character referred to.

Another object is to provide a suspension file with novel hook-like suspension elements.

Another object is to provide novelly constructed hanger hooks for a suspension file.

Another object is to provide a suspension file with means to suspend same either horizontally or angularly.

Another object is to provide a handle type suspension bar for a suspension file folder.

Another object is to provide a structure of the character referred to which is not difficult or expensive to manufacture, nor more difficult to produce than prior known structures of this general character but which is more efficient in its use.

Other objects and advantages of the invention will become more apparent with reference to the following description and accompanying drawings.

In the drawings:

FIG. 1 is a perspective view of a suspension file folder including the novel slidable hanger hook elements.

FIG. 2 is a fragmentary elevational view of one end of the suspension file folder showing the hanger hook element extended.

FIG. 3 is a similar view showing the hanger hook element withdrawn inside the end edge of the suspension file folder.

FIG. 4 is a view showing the suspension file suspended horizontally from two hanger rods.

FIG. 5 is a view showing the suspension file suspended angularly from one hanger rod or other support.

Figure 6:
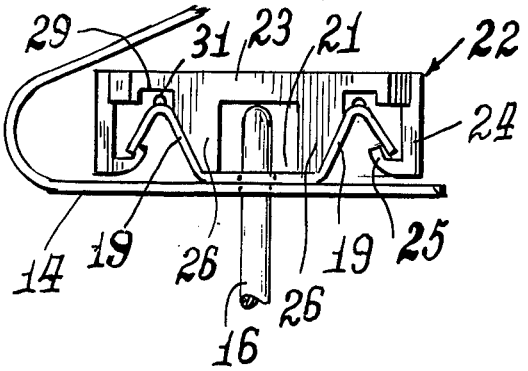
FIG. 6 is an end view of the hanger hook element and compressor bar upon which it is mounted.

Referring now to the preferred form of structure shown in FIGS. 1 through 6, the structure is shown associated with a file folder, generally indicated at 11, which comprises front and back covers 12, 13 respectively, each having an attached flap 14 hingedly connected thereto. A stack of sheets 15 is arranged between flaps 14 and is secured therebetween by bendable prongs or posts 16, preferably made from suitable plastic, such as nylon. These prongs or posts pass through the sheets and through registering holes 17 in the flaps and in compressor bars 18 laid over said flaps, and their projecting ends are bent down inwardly toward each other against the compressor bar.

The compressor bar 18 preferably is fabricated from thin sheet metal and it includes a pair of laterally spaced longitudinal upstanding rails 19 which have their bottom edges elevated from the plane of the bottom face of the compressor bar. These rails define a longitudinal channel 21 between them in which the bent down prong or post portions 16 lie, and also define tracks upon which hanger hook elements 22 are slidable.

The hanger hook elements 22 preferably are fabricated from tough plastic material, such as nylon. As shown, one such element is provided adjacent each end of the compressor bar and each comprises a rectangular body including a web 23 that overlies and bridges the channel 21 and have downturned side portions 24 with inturned flanges 25 that embrace the rails 19 so as to slidably retain the elements on the compressor bar.

The bottom face of the hanger hook element 22 is formed with a pair of longitudinally extending ribs 26 spaced apart a distance to embrace loosely the underlying prong portion 16 to thereby insure that it lies within the channel. Preferably, the spaced ribs 26 ride on the inside wall of the track or rail 19 and afford added strength to the mounting.

Each hanger hook element 22 has projecting from one end thereof an extension comprising a narrow-width neck 27 terminating at its outer end in at least one substantially right-angular projection 33 whose end 34 angles towards the slide-member web portion thereby to define a recess or notch 28. When provided with two recesses the element can be placed at either end of the compressor bar. The under face of the extension and the adjacent end of web 23 is formed with a pair of blind slots 29, that open onto the free end of the extension. These slots afford clearance for a stop dimple 31 formed at the end of each rail 19 to permit sliding of the elements 22 into hook extending position. Such movement is limited by the dimples abutting the inner closed end of the blind slots 29. The top surface of web 23 preferably is formed with lateral depressions 32 to facilitate finger engagement with the hook element for manually sliding it along the compressor bar.

The presence of the recess or recesses 28 in the edges of extension 27 leaves at the free end of the extension a lateral projection or projections 33 which has integral with its free end a wing 34 that projects at an acute angle to the axis of the body so as to provide a clearly defined hook or barb.

The hanger hook elements 22 are adapted for positioning in three positions. A first position, shown in FIG. 2, is at the end of the compressor bar 18 so as to project the hook extension beyond the compressor bar end. When in this position, the suspension file can be suspended between two hanger rods 35, as shown in FIG. 4, or it may be suspended from one hanger rod 36 as shown in FIG. 5. This latter manner of hanging locates the file folder 11 in an angular position so that should the spine of the file folder bear indicia, it may be readily observed.

A second position is shown in FIG. 3, where the hanger hook element 22 is moved inwardly of the ends of the compressor bar 18 to locate the hanger hooks within the margins of the file folder. A third position is when the hanger hook element is moved inwardly beyond the free end of the bent down prong. When in either the first or second positions, the hanger hook element 22 overlies and holds the prong portion 16 bent down into the channel. Manual sliding movement of the hook element 22 is facilitated by forming the rear end thereof concave, as shown at 22a, to enable the user to readily engage said end with one finger of the hand.

Figure 7:
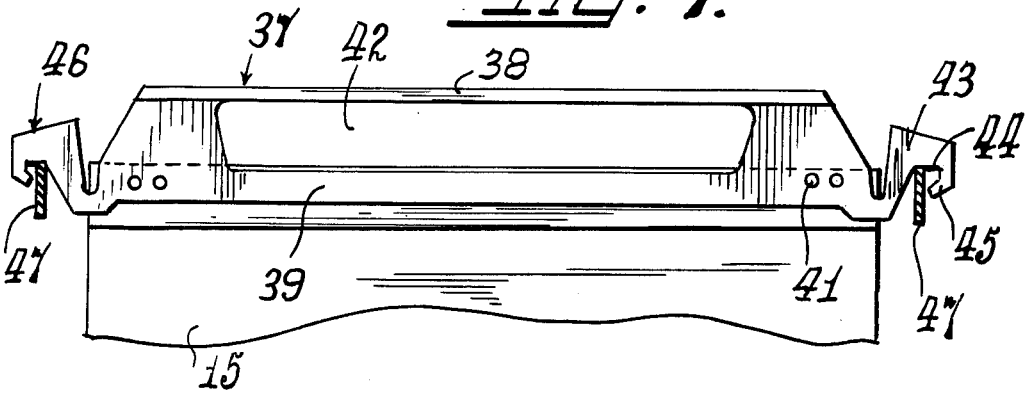
FIG. 7 is an elevational view of a suspension handle for a suspension file folder.
Figure 8:
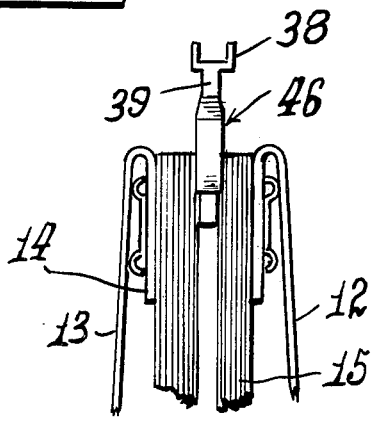
FIG. 8 is an end elevational view of the structure shown in FIG. 7.
Figure 9:
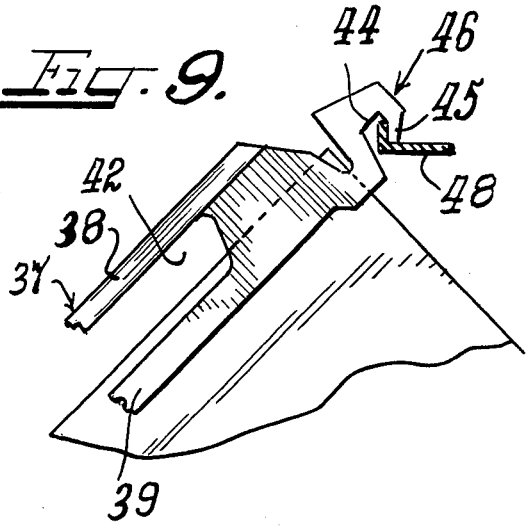
FIG. 9 is a fragmentary view showing the suspension file equipped with the suspension handle suspended from one hanger rod or like support.

Referring to the structure shown in FIGS. 7 through 9, an elongated hanger bar 37 is formed substantially T-shaped in section to define an elongated head portion 38 adapted to be slidably engaged in an inverted U-shaped track (not shown) and a web portion 39 suitably apertured, as at 41, to receive binder posts or other means for detachably securing a file folder thereto. Preferably, the web portion 39 has an elongated opening 42 therein affording means whereby the T-shaped portion may be readily grasped in the manner of a handle for holding the assembly in the hand.

Instead of supporting the hanger bar by means of its T-shaped structure from a track, said bar is provided with an end extension 43 having a laterally extending projection 43a on its free end defining an undercut 44, on its bottom edge. The free end of the projection is provided with an angularly disposed wing 45 that projects in the direction of the undercut so as to provide, with the undercut, a hook portion 46. The hanger bar 37 may be suspended between two parallel support rods 47 by seating the undercut thereon, as shown in FIG. 7, or the hook portion 46 on one end of the hanger bar may be engaged over a single support rod 48, as shown in FIG. 9, whereby the file folder will be suspended at an angle so as to locate indicia on the spine in position for ready visibility.

Although I have described preferred embodiments of the invention, in considerable detail, it will be understood that the description thereof is intended to be illustrative, rather than restrictive, as details of the structure may be modified or changed without departing from the spirit or scope of the invention. Accordingly, I do not desire to be restricted to the exact construction shown and described.

I claim:

1. A hanger hook assembly for a suspension file folder comprising, in combination, an elongated compressor bar, a rail on each longitudinal edge of said bar forming a longitudinal channel between them, said bar having at least two holes one inwardly from each end of the bar, a pair of flexible posts one extended through each of said holes and being bent over inwardly toward each other to lie within the channel, a pair of slide members each having a body including a web portion bridging the channel and slidably engaged with the longitudinal rails, an extension on the outwardly disposed end of each slide-member web portion, said extension comprising a planar narrow-width neck terminating at its outer end in at least one substantially right-angular projection having a free end which angles towards the slide-member web portion thereby to define a hook, stops on the ends of the rails, and blind slots on the under faces of the web portion positioned to receive the stops and thereby limit outward sliding of the slide member.

* * * * *